US007340207B2

(12) United States Patent
Cho et al.

(10) Patent No.: US 7,340,207 B2
(45) Date of Patent: Mar. 4, 2008

(54) FUSING ROLLER AND FUSING APPARATUS ADOPTING THE SAME

(75) Inventors: Durk-hyun Cho, Suwon-si (KR); Joong-gi Kwon, Gunpo-si (KR); Hwan-guem Kim, Eunpyeong-gu (KR); Young-min Chae, Suwon-si (KR); Sang-yong Han, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 133 days.

(21) Appl. No.: 11/211,567

(22) Filed: Aug. 26, 2005

(65) Prior Publication Data

US 2006/0093415 A1 May 4, 2006

(30) Foreign Application Priority Data

Nov. 2, 2004 (KR) ..... 10-2004-0088173

(51) Int. Cl.
*G03G 15/20* (2006.01)

(52) U.S. Cl. ..... 399/328; 219/216; 219/619; 399/90

(58) Field of Classification Search ..... 399/90, 399/328, 330, 333; 219/216, 469, 619; 347/156
See application file for complete search history.

(56) References Cited

U.S. PATENT DOCUMENTS 6,236,830 B1 5/2001 Hoberock et al.
6,340,810 B2 * 1/2002 Yokoyama et al. ..... 219/619
2002/0098020 A1 * 7/2002 Omoto et al. ..... 399/328
2004/0037579 A1 * 2/2004 Hashiguchi et al. .... 399/328 X
2004/0101335 A1 * 5/2004 Cho et al. ..... 399/330
2006/0045586 A1 * 3/2006 Kim et al. ..... 399/328
2006/0093414 A1 * 5/2006 Cho et al. ..... 399/328

FOREIGN PATENT DOCUMENTS

| | | |
|---|---|---|
| CN | 1142624 | 7/1997 |
| JP | 57-029068 | 2/1982 |
| JP | 04-153683 | 5/1992 |
| JP | 11-339940 | 12/1999 |
| JP | 2002-174973 | 6/2002 |
| JP | 2003-317899 | 11/2003 |
| JP | 2003-323069 | 11/2003 |
| JP | 2004-020997 | 1/2004 |
| KR | 1020030005551 | 1/2003 |
| KR | 1020040021967 A | 3/2004 |
| KR | 1020040022701 A | 3/2004 |

* cited by examiner

*Primary Examiner*—Sophia S. Chen
(74) *Attorney, Agent, or Firm*—Roylance, Abrams, Berdo & Goodman, L.L.P.

(57) ABSTRACT

A fusing roller and a fusing apparatus using the same are provided. The fusing roller includes a coil unit resistance heated by a predetermined alternating current, and an alternating magnetic flux is generated by the alternating current. A heating roller unit is heated by an induced current generated by the alternating magnetic flux. End caps are installed on both ends of the heating roller unit and have electrodes for receiving power from an external power source. Reduction units are formed on both ends of the coil unit to reduce contact resistance generated when the coil unit contacts the electrodes.

16 Claims, 4 Drawing Sheets

FUSING ROLLER AND FUSING APPARATUS ADOPTING THE SAME

CROSS REFERENCE TO RELATED APPLICATION

This application claims the benefit under 35 U.S.C. § 119(a) of Korean Patent Application No. 10-2004-0088173, filed on Nov. 2, 2004, in the Korean Intellectual Property Office, the entire disclosure of which is hereby incorporated by reference.

BACKGROUND OF THE INVENTION

1. Field of the Invention

The present invention relates to a fusing apparatus. More particularly, the present invention relates to a fusing apparatus including a fusing roller that fuses an image on a sheet of paper by induced heating.

2. Description of the Related Art

Generally, an image forming apparatus using an electrophotographic method, such as laser printers or digital copying machines, is an apparatus printing a mono-color image or a full-color image by forming an electrostatic latent image by scanning light onto a photosensitive medium charged to a predetermined electric potential. The electrostatic latent image is developed using toner of a predetermined color in a developing unit, and transferring and fusing the developed image onto a sheet of paper. Thus, a mono-color image or a full-color image is printed.

The electrophotographic image forming apparatus can be classified into a wet type image forming apparatus and a dry type image forming apparatus.

The wet type electrophotographic image forming apparatus uses a developer that is made by distributing powder toner in a liquid carrier. The dry type electrophotographic image forming apparatus uses a binary developer in which powder carrier and toner are mixed, or a single developer without the carrier. Hereinafter, the dry type electrophotographic image forming apparatus will be described, and the developer will be referred to as a toner.

FIG. 1 is a transverse cross-sectional view of a fusing apparatus using a halogen lamp as a heat source, according to the conventional art. FIG. 2 is a longitudinal cross-sectional view of the apparatus along line I-I" of FIG. 1.

The fusing apparatus 10 includes two cylindrical fusing rollers 11 and 12 formed of aluminum. Both ends of the fusing rollers 11 and 12 are supported by bearings 14 that contact each other in a lengthwise direction. Coating layers 13 are formed on surfaces of the fusing rollers 11 and 12 for forming a nip where heat transmission to the images is performed, and improving releasing of the images.

A heating unit 15 uses a halogen lamp as a heat source and is connected to an external power source (not shown) to generate heat. The heating unit is installed in each fusing roller 11 or 12. The heating unit 15 is separated from the fusing roller 11 or 12, and air is filled therebetween.

When electric current provided from the external power source (not shown) is applied to both ends of the heating unit 15, the heating unit 15 generates radiation energy. The generated radiation energy is transmitted to inner walls of the fusing rollers 11 and 12 through the air, and a light/heat conversion layer formed as a black body converts the radiation energy into heat energy. The converted heat energy is transmitted to the image 21 on a recording medium 20 that passes through the nip, where the fusing rollers 11 and 12 contact each other, and through the fusing rollers 11 and 12 and the coating layer 13. Therefore, the image 21 is melted by the heat energy, and fused on the recording medium 20.

However, the fusing apparatus using the halogen lamp as the heat source has the following problems.

When the power source is supplied to perform the printing operation, a long warm-up time is required until the temperature reaches the fusing temperature from the normal temperature. A user should wait until the fusing roller reaches the fusing temperature before the printing operation can be performed.

Additionally, since the halogen lamp and the fusing roller are separated from each other and air is filled therebetween, the heat generated by the halogen lamp heats the fusing roller by radiation, and passes through the fusing roller by conduction. Therefore, the heat transmission speed is low, and heat efficiency is lowered.

The halogen lamp is connected to an external power source to receive power from the external power source. Contact resistance may be generated at a contact portion where the halogen lamp is connected to the external power source. The contact resistance may oxidize the contact portion or make the contact portion corroded, thus power may not be supplied from the power source efficiently.

Accordingly, a need exists for an improved fusing roller that reduces contact resistance and increases the efficiency of induced heating.

SUMMARY OF THE INVENTION

The present invention provides a fusing roller that reduces contact resistance of a coil unit that contacts an electrode and maximizes an induced heating efficiency by concentrating magnetic flux, and a fusing apparatus using the fusing roller.

According to an aspect of the present invention, a fusing roller fuses an image on a sheet of paper. The roller includes a coil unit resistance heated by a predetermined alternating current, and an alternating magnetic flux generated by the alternating current. A heating roller unit is heated by an induced current generated by the alternating magnetic flux. End caps are installed on both ends of the heating roller unit and have electrodes for receiving power from an external power source. Reduction units are formed on both ends of the coil unit to reduce contact resistance generated when the coil unit contacts the electrodes.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
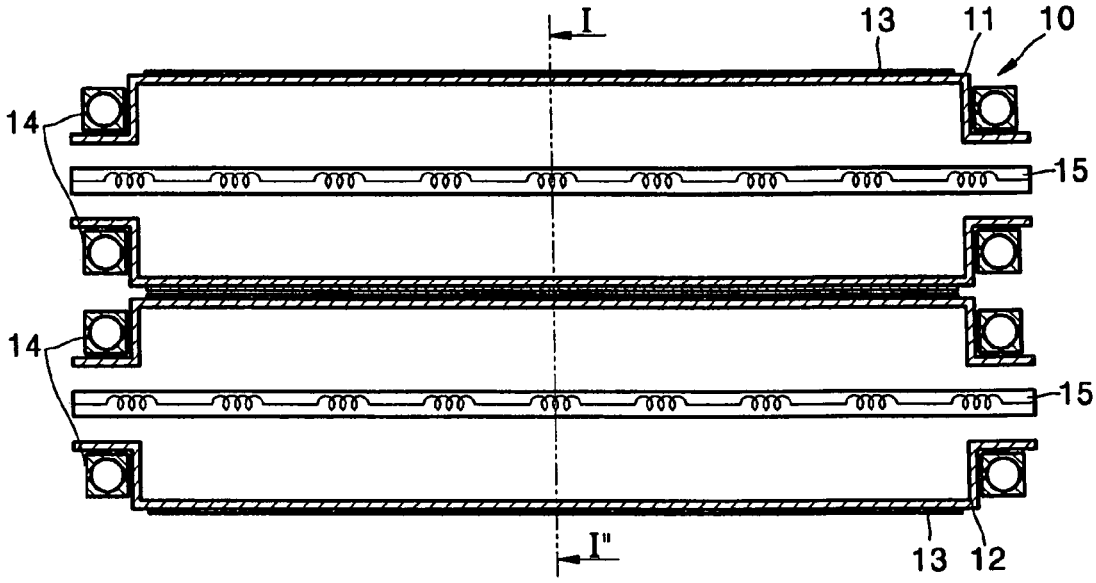
FIG. 1 (PRIOR ART)
FIG. 1 is a transverse cross-sectional view of a fusing apparatus using a halogen lamp as a heat source, according to the conventional art.
Figure 2:
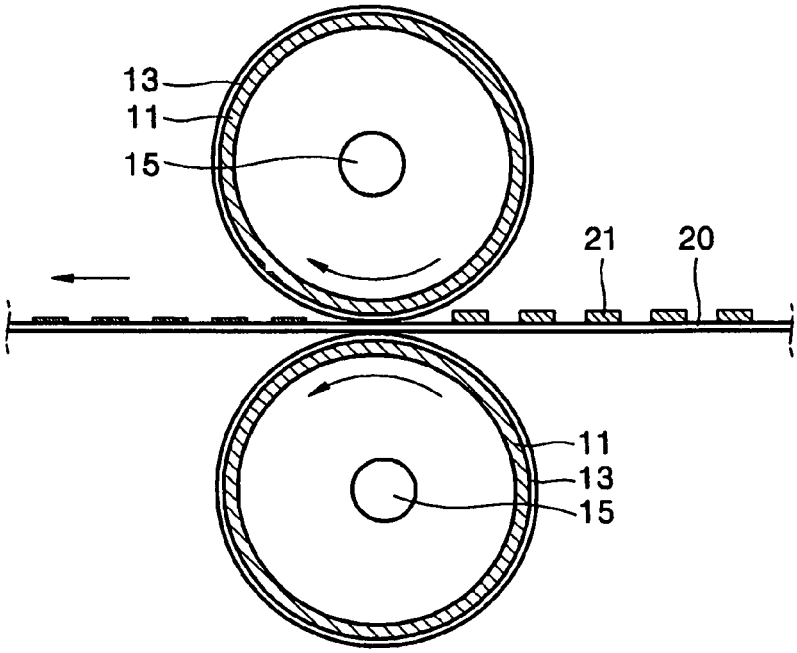
FIG. 2 (PRIOR ART)
FIG. 2 is a longitudinal cross-sectional view of the fusing apparatus along line I-I' of FIG. 1.
Figure 3:
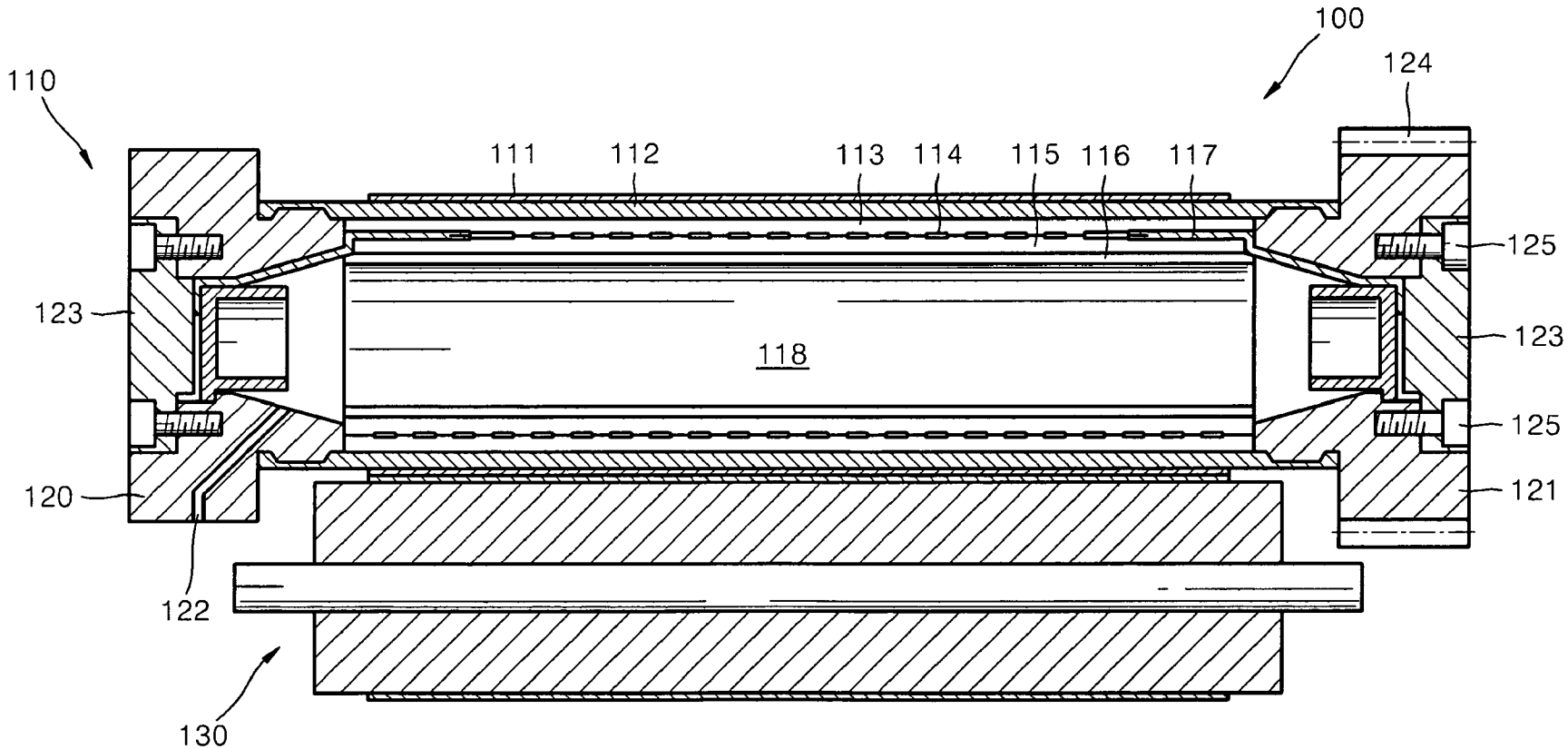
FIG. 3 is a transverse cross-sectional view of a fusing apparatus, according to an exemplary embodiment of the present invention.
Figure 4:
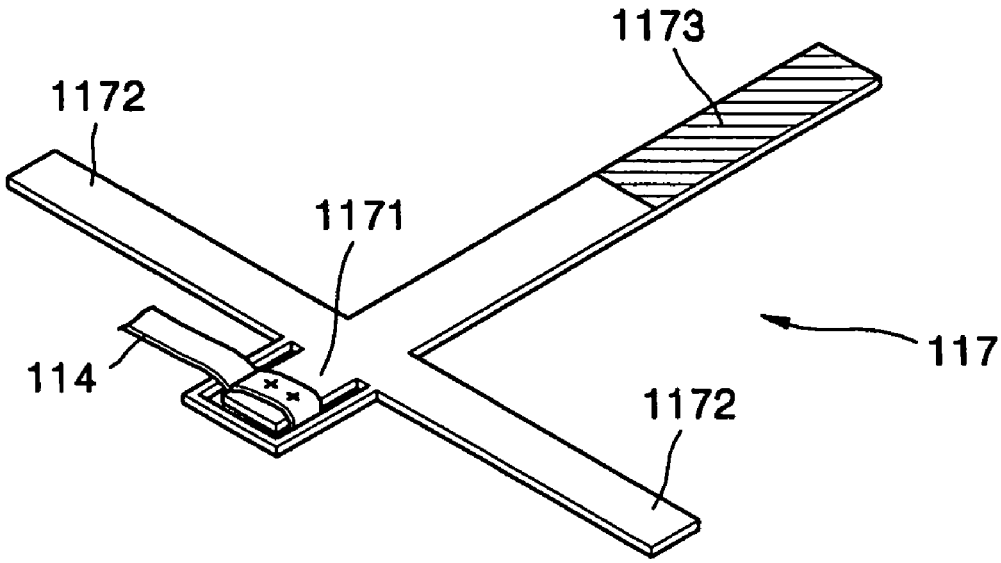
FIG. 4 is a perspective view of a reducing unit according to an exemplary embodiment of the present invention.
Figure 5:
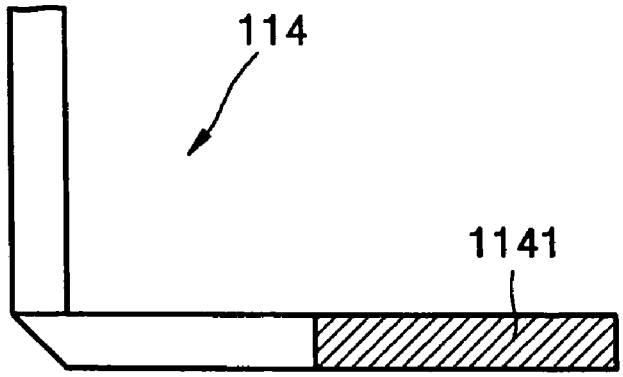
FIG. 5 is a perspective view of another example of the reducing unit according to an exemplary embodiment of the present invention.

Referring to FIGS. 3 through 5, a fusing apparatus 100 includes a fusing roller 110 that generates heat to fuse a toner image onto paper, and a pressing roller 130 that faces the fusing roller 110 and contacts the fusing roller in an axial direction thereof to press the paper passing between the fusing roller 110 and the pressing roller 130 toward the fusing roller 110.

The pressing roller 130 has a cylindrical body 131 that is rotatably supported by a shaft 133. A coating layer 132 is formed on an outer circumferential surface of the body 131 for improving a releasing property with the toner image. If necessary, a fusing roller may be used instead of using the pressing roller to transmit the heat while pressing the paper.

The fusing roller 110 includes a heating roller unit 112, a coil unit 114, and an adhering unit 116.

The heating roller unit 112 is formed of a magnetic substance that has a cylindrical shape with an empty inner space. A coating layer 111 is preferably formed of tetrafluoruethylene on a surface of the heating roller unit 112 for improving the releasing property with the toner image. The heating roller unit 112 is magnetized by an electromagnetic field and has a conductive property by which a predetermined amount of current flows. For example, the heating roller unit 112 may formed of Fe alloy, Cu alloy, Al alloy, Ni alloy, or Cr alloy.

The coil unit 114 is installed to be adhered to the inner side of the heating roller unit 112 in a spiral shape, and generates an alternating magnetic flux that is changed in response to the current input from an external power source (not shown). Preferably, the coil unit 114 is formed using a ribbon coil of Cu material.

A first insulating layer 113 is disposed between the coil unit 114 and the heating roller unit 112, and a second insulating layer 115 is disposed between the coil unit 114 and the adhering unit 116. Thus, dielectric breakdown due to alternating current (AC) input into the coil unit 114 is not generated, and leakage current does not flow to the heating roller unit 112 or to the adhering unit 116.

The first and second insulating layers 113 and 115 preferably have predetermined withstand voltage properties and dielectric breakdown resistance properties. The withstand voltage property is that the insulating layer withstands a predetermined power, and the dielectric breakdown resistance means that leakage current does not exceed 10 mA for one minute under the maximum withstand voltage and the dielectric breakdown does not occur. The first and second insulating layers 113 and 115 may be formed of mica, polyimide, ceramic, silicon, polyurethane, glass, or polytetrafluoruethylene (PTFE).

The adhering unit 116 is installed in the space 118 in the heating roller unit 112 to adhere the coil unit 114 toward the heating roller unit 112, and is an elastic material that elastically biases the coil unit 114 toward the heating roller unit 112.

Preferably, the adhering unit 116 is a non-magnetic material, since the induced heat should be generated on the heating roller unit 112, not on the adhering unit 116 by the alternating magnetic flux generated by the coil unit 114 to fuse the toner image on the paper.

An end cap 120 and an end cap 121 for transmitting driving power are installed on both ends of the heating roller unit 112. The power transmission end cap 121 has substantially similar structure to that of the end cap 120, however, it includes a power transmission unit 124, such as a gear for connecting to a power apparatus (not shown) and rotating the fusing roller 110.

An air vent 122 is formed on the end cap 120. The air vent 122 flows air between the inner space 118 of the heating roller unit 112 and the outside after the end cap 120 is installed on the heating roller unit 112, thus the pressure of the inner space 118 may be maintained at the atmosphere pressure.

Therefore, even when the heating roller unit 112 is heated by the heat transmitted from the coil unit 114, the outer air may flow in the inner space 118 through the air vent 122 and the atmosphere pressure may be maintained. The air vent 122 may be formed on the power transmission end cap 121. Otherwise, the air vent 122 may be formed on both the end cap 120 and the power transmission end cap 121. Additionally, the air vent 122 is not an essential element.

Electrodes 123 are installed on the end cap 120 and the power transmission end cap 121. The electrode 123 is electrically connected to lead units 117 formed on both ends of the coil unit 114. The electric current input from the outside is supplied to the coil unit 114 after passing through the electrode 123 and the lead unit 117. Preferably, the electrode 123 is secured to the end cap 121 by fasteners 125.

Lead units 117 are separately formed on the both ends of the coil unit 114, as shown in FIG. 4.

The lead unit 117 includes a connection portion 1171, a fixation portion 1172, and a reduction portion 1173.

The lead unit 117 is preferably formed of phosphor bronze, and surrounds the adhering unit 116 using the fixation portion 1172, thus the lead unit 117 is fixed on both ends of the coil unit 114. In addition, both ends of the coil unit 114 are fixed on the connection portion 1171 preferably by a laser welding method and electrically connected.

The reduction portion 1173 is formed on a portion of the lead unit 117 contacting the electrode 123. Preferably, the reduction portion 1173 is coated by one of Au, Ag, Pt, and Pb to minimize the contact resistance caused by the corrosion or the oxide layer generated when the reduction portion 1173 contacts the electrode 123.

Referring to FIG. 5, the reduction portion 1141 is formed on the both ends of the coil unit 114. That is, the additional lead unit 117 shown in FIG. 4 is not formed, but the coil unit 114 is extended and a reduction portion 1141 that is preferably coated by one of Au, Ag, Pt, and Pb is formed on the end of the extended coil unit 114.

Figure 6:
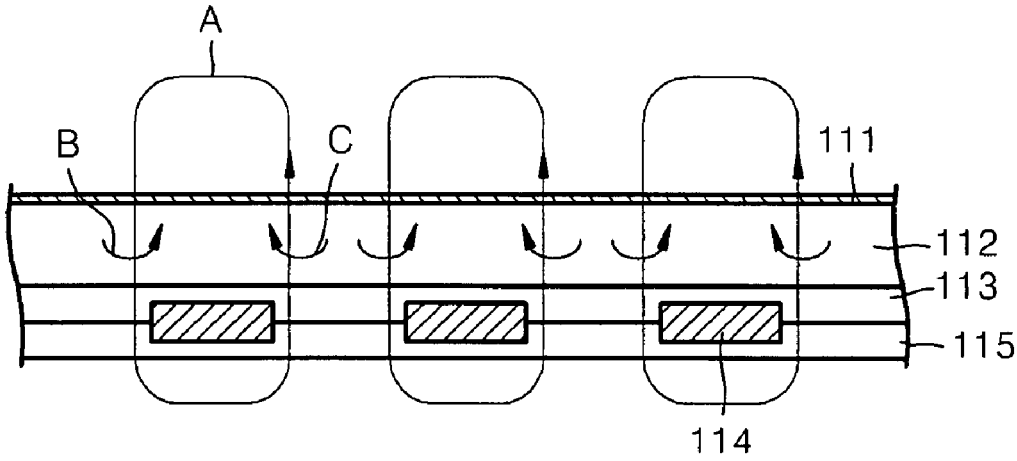
FIG. 6 is a schematic elevational view in partial cross section of heat generated by a heating roller unit due to an induction current in the fusing roller according to an exemplary embodiment of the present invention.
Figure 7:
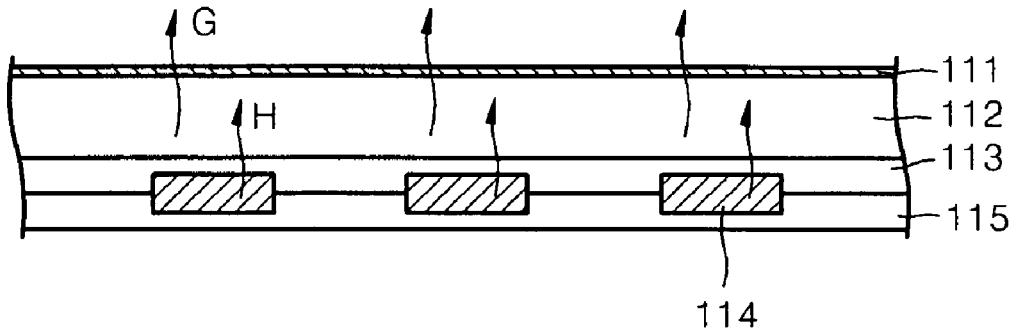
FIG. 7 is a schematic elevational view in partial cross section of a heating source that generates heat in the fusing roller according to an exemplary embodiment of the present invention.

Referring to FIG. 6, when the AC is input into the coil unit 114 from the power supplying unit (not shown), the coil unit 114 generates an alternating magnetic flux (A) denoted by a solid line in FIG. 6. The alternating magnetic flux (A) generated by the coil unit 114 crosses the heating roller unit 112. Induced currents B and C of different directions from each other are generated by the heating roller unit 112 by the change of the alternating magnetic flux crossing the heating roller unit 112. Here, it is assumed that the current flows on the coil unit 114 in a direction from the ground.

Here, since the heating roller unit 112 has its own specific resistance, the induced currents B and C generate Joule heat G (hereinafter, referred to as induced Joule heat) on the heating roller unit 112. The induced Joule heat G is transmitted to the toner image through the protective layer 111 by the heating roller unit 112.

Additionally, since the coil unit 114 has the specific resistance, it is heated by the input AC and generates Joule heat (hereinafter, referred to as resistance Joule heat, H). The resistance Joule heat H is transmitted to the toner image (not shown) through the first insulating layer 113, the coil unit 114, and the protective layer 111.

Thus, when the AC is input into the coil unit 114, the toner image transferred on the recording medium (not shown) is fused on the medium by the induced Joule heat G generated by the induced currents B and C of the heating roller unit 112 caused by the alternating magnetic flux A generated around the coil unit 114 and the resistance Joule heat H generated by the coil unit 114.

As described above, according to the fusing roller of an exemplary embodiment of the present invention, the reduction portion that is coated is formed on the coil unit that contacts the electrode, thus the contact resistance at the portion contacting the electrode may be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fusing roller for fusing an image on a sheet of paper, comprising:

a coil unit resistance heated by a predetermined alternating current and generating an alternating magnetic flux by the alternating current;

a heating roller unit heated by an induced current generated by the alternating magnetic flux;

end caps installed on both ends of the heating roller unit and having electrodes for receiving power from an external power source; and reduction units formed on both ends of the coil unit to reduce a contact resistance generated when the coil unit contacts the electrodes.

2. The fusing roller of claim 1, wherein lead units at both ends of the coil unit electrically connect the coil unit and the electrodes.

3. The fusing roller of claim 2, wherein the reduction units are formed on a portion of the coil unit that contacts the electrodes.

4. The fusing roller of claim 2, wherein the lead units are connected to the coil unit by a laser welding method.

5. The fusing roller of claim 1, wherein the reduction units are coated by one of the materials selected from a group consisting of Pb, Au, Ag, and Pt.

6. The fusing roller of claim 1, wherein the coil unit is formed of a ribbon coil of Cu material.

7. The fusing roller of claim 1, wherein the lead units are preferably formed of phosphor bronze.

8. The fusing roller of claim 1, wherein an adhering unit connects the coil unit to an inner surface of the heating roller.

9. A fusing apparatus, comprising:

a fusing roller generating heat for fusing an image onto a sheet of paper; and a pressing roller facing and contacting the fusing roller to adhere the paper toward the fusing roller, wherein the fusing roller includes:

a coil unit resistance heated by a predetermined alternating current and generating an alternating magnetic flux by the alternating current;

a heating roller unit heated by an induced current generated by the alternating magnetic flux;

end caps installed on both ends of the heating roller unit and having electrodes for receiving power from an external power source; and reduction units formed on both ends of the coil unit to reduce contact resistance generated when the coil unit contacts the electrodes.

10. The fusing apparatus of claim 9, wherein lead units are formed on both ends of the coil unit to electrically connect the coil unit and the electrodes.

11. The fusing apparatus of claim 10, wherein the reduction units are formed on a portion of the coil unit that contacts the electrodes.

12. The fusing apparatus of claim 10, wherein the lead units are connected to the coil unit by a laser welding method.

13. The fusing apparatus of claim 9, wherein the reduction units are coated by a material selected from a group consisting of Pb, Au, Ag, and Pt.

14. The fusing roller of claim 9, wherein the coil unit is formed of a ribbon coil of Cu material.

15. The fusing roller of claim 9, wherein the lead units are preferably formed of phosphor bronze.

16. The fusing roller of claim 9, wherein an adhering unit connects the coil unit to an inner surface of the heating roller; and a first insulating layer is disposed between the coil unit and the heating roller unit, and a second insulating layer is disposed between the coil unit and the adhering unit.

* * * * *